United States Patent [19]

Berger

[11] Patent Number: 4,757,650

[45] Date of Patent: Jul. 19, 1988

[54] CABLE DOME SYSTEM WITH MAIN CABLES ORIENTED ALONG CHORDS

[76] Inventor: Horst L. Berger, 18 Chestnut Dr., Hastings-on-Hudson, N.Y. 10706

[21] Appl. No.: 913,337

[22] Filed: Sep. 30, 1986

[51] Int. Cl.[4] ..... E04B 7/14

[52] U.S. Cl. ..... 52/81; 52/80; 52/83; 52/DIG. 10

[58] Field of Search ..... 52/81, 82, 83, 6, DIG. 10, 52/80

[56] References Cited

U.S. PATENT DOCUMENTS

| | | | |
|---|---|---|---|
| 693,989 | 2/1902 | Vail | 52/82 |
| 2,908,236 | 10/1959 | Kiewitt | 52/81 |
| 3,496,687 | 2/1970 | Greenberg et al. | 52/80 |
| 3,744,191 | 7/1973 | Bird | 52/81 |
| 3,968,808 | 7/1976 | Zeigler | 52/81 |
| 4,112,956 | 9/1978 | Small | 52/83 |
| 4,130,969 | 12/1978 | Ivanov | 52/80 |
| 4,450,656 | 5/1984 | Lagendijk | 52/83 |

OTHER PUBLICATIONS

Architectural Record; Aug. 1959; (pp. 178–181).

*Primary Examiner*—Carl D. Friedman
*Assistant Examiner*—Michael Safavi
*Attorney, Agent, or Firm*—Cooper & Dunham

[57] ABSTRACT

A cable dome has lower and upper outer cables each connecting nodes of an edge ring which are spaced by two other nodes. The lower and upper cables connecting the same nodes are spaced from each other in elevation by a pair of outer struts each having an upper and a lower node. Each upper node in turn supports lower and upper inner cables, serving a function similar to that of a corresponding edge ring node.

14 Claims, 12 Drawing Sheets

FIG. 1
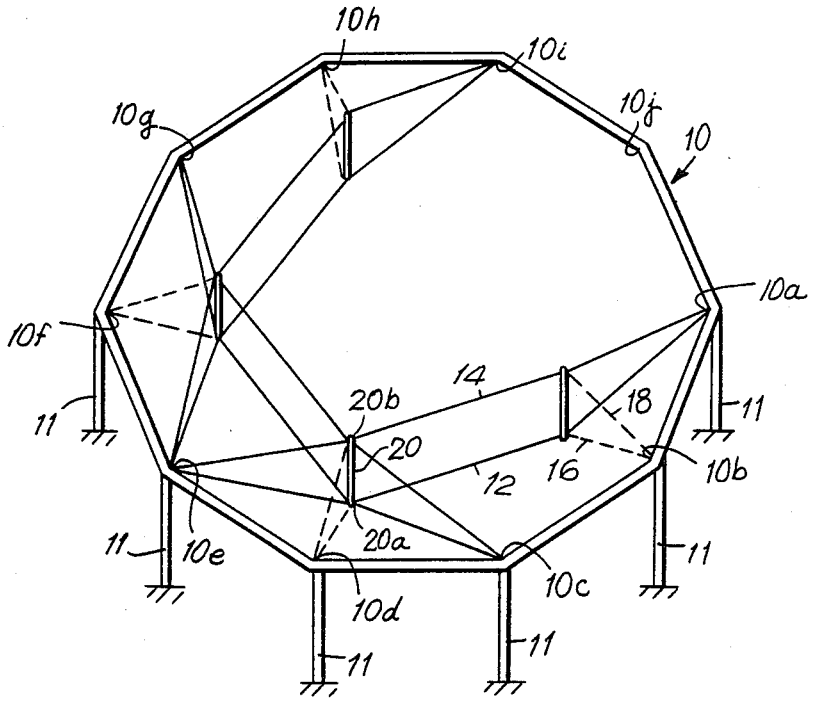
FIG. 2
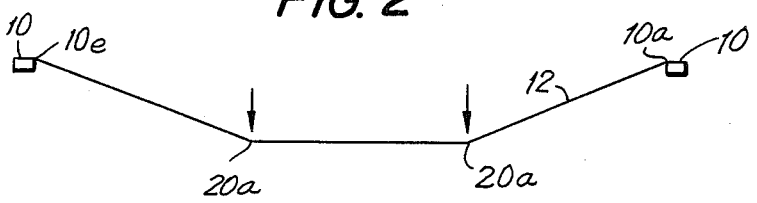
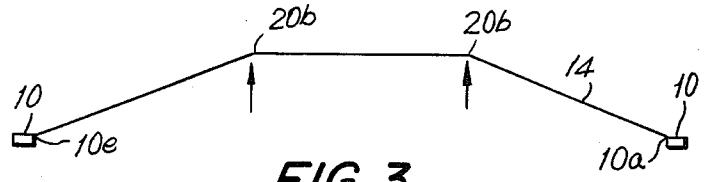
FIG. 3

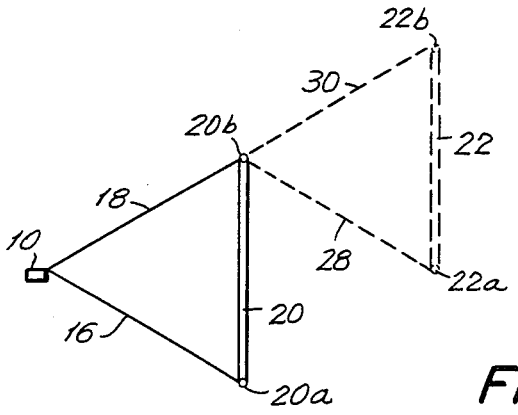
FIG. 4
FIG. 5a
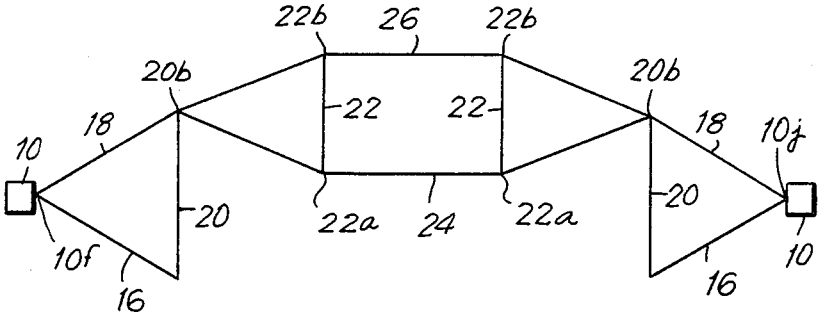

FIG. 9
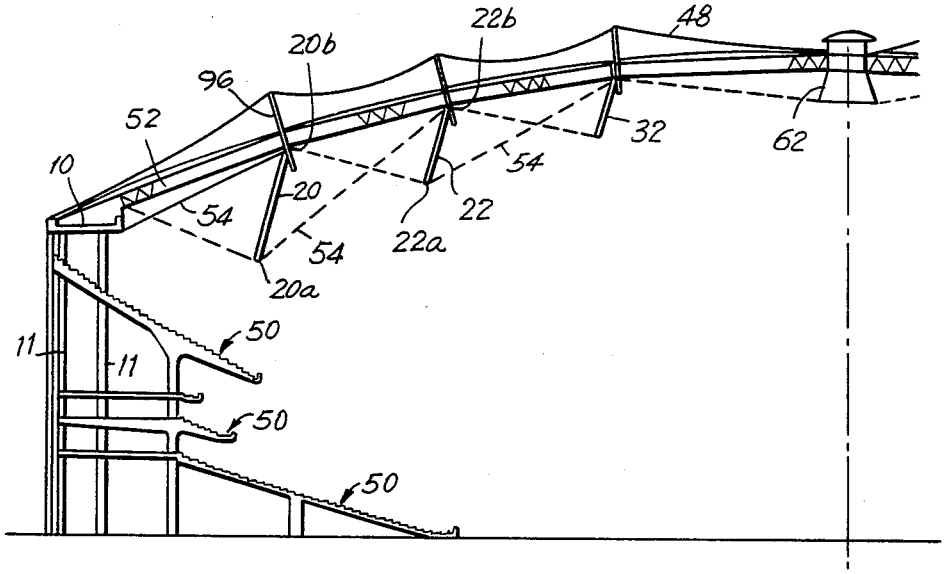
FIG. 10
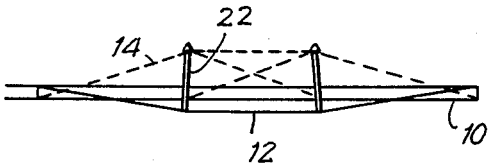
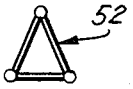
FIG. 11

FIG. 14a
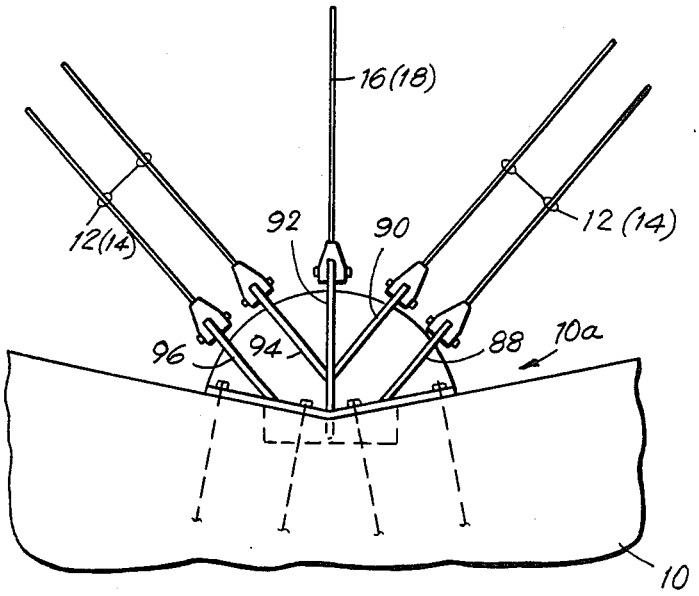
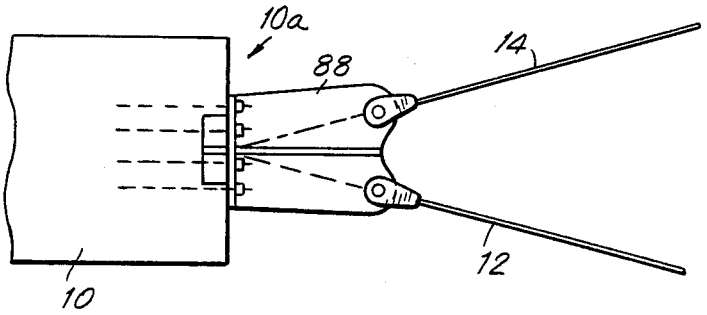
FIG. 14b

CABLE DOME SYSTEM WITH MAIN CABLES ORIENTED ALONG CHORDS

BACKGROUND AND SUMMARY OF THE INVENTION

The invention is in the field of shelter structures and relates particularly to structures using lightweight roof membrane shapes. Examples are air-supported structures, tension structures, tent-like structures, arch-supported membranes, and free-span, point-supported systems. A survey of fabric tension structures for permanent buildings can be found in a presentation by the inventor herein to the International Symposium on Spatial Roof Structures at Dortmund, Germany on Sept. 10, 1984 entitled "A Decade of Fabric Tension Structures for Permanent Buildings." Additional background material on such structures can be found in the 12 references cited at pages 19 and 20 of the presentation. An example of such a structure is shown in U.S. Pat. No. 4,581,860 granted to the inventor herein. The presentation and its 12 references and said patent are hereby incorporated by reference in this specification as though fully set forth herein.

Tension structures depend upon shape and prestress for their stability and capacity of carrying loads. Tent-like tension structures are generally center-supported systems which may use suspension bridge concepts and double cantilevers. One or several peaks supported by central masts are the common forms. The "Florida Festival" structures at Sea World in Orlando, Fla. use the tent principles in a composition of vertical tents and their inversion. The roof membranes are supported by radial cables spanning from central poles to concrete edge beams. When internal supports are not desirable special means need to be developed to achieve free spans. Arch-supported structures are one method of developing free spans. One example is the Bullock's Department Store in San Jose, Ca. in which the roof fabric rides over a system of arches as in U.S. Pat. No. 3,807,421. Another method of creating free-span structures relies on point-supported systems; e.g., systems in which the free span is created by large A-frames supporting the main structural peaks from overhead in combination with peripheral poles restrained by stay cables. An example is the outdoor pavilion for the Crown Center in Kansas City, Mo. The integration of such A-frames into a balanced stress system is illustrated in the inventor's prior U.S. Pat. No. 3,773,061. Other examples of free-span tension structures are described or referred to in said presentation by the inventor herein and its references. For large and very large spans the use of a compression edge ring and short vertical compression struts together with a cablenet system is particularly effective. Said U.S. Pat. No. 4,581,860 granted to the inventor herein discloses a shelter structure using a saddle-shaped cable dome system for a large-span lightweight roof membrane. The structure uses the curvature of a saddle surface restrained with a warped edge ring, combined with two orthogonal cable nets separated by a set of compression struts to create an efficient structural system confined by the warped edge ring loaded primarily in compression.

The desirable characteristics of structures of this general type include high strength-to-weight ratio and ease and low cost of erection and maintenance. While much progress has been made in this field, it is believed that a need still remains to improve these and other desirable characteristics, and the invention is directed to meeting that need. The invention is particularly useful for facilities such as stadiums, arenas, and other large assembly spaces which use a horizontal edge ring and need high clearance in the center. Its objects include providing a structure which (i) can be erected simply and inexpensively, using commonly available materials and equipment, (ii) uses a structural fabric membrane forming a substantially continuous waterproof roof surface which avoids problems arising from temperature differentials and resulting geometric incompatibilities between roof and support structure, (iii) reduces and simplifies maintenance, and (iv) creates visual systems pleasing to the eye. The roof system can be translucent in whole or in part, and/or can be insulated. Provisions can be made for retractable roof covers.

In one exemplary embodiment of the invention the geometric configuration is such that compression forces act on a peripheral, edge support ring and on vertical or slanted compression struts which, together with a system of tension members (e.g. high strength cables) form a truss-like configuration. The cables are directly or indirectly supported by the edge ring, requiring no spinning, prefabrication, and multiple point lifting of ring cables. Main cables form simple spans on chords of concentric rings. The fabric membrane can form an integral part of the structural system. However, the stability of the main system is not dependent on the fabric. The system can be stressed by means of the vertical struts, avoiding the need for heavy stressing equipment and expensive adjustable cable connections.

A system which embodies an example of the invention uses a substantially rigid, generally laterally extending edge ring which has cable attachment nodes. Lower main outer cables connect respective edge ring nodes such that each of these cables intersects two other lower main outer cables at two respective lower outer strut nodes. An outer compression strut is supported at a respective lower outer strut node by two lower main outer cables and extends upwardly therefrom. The outer struts in plan view are spaced radially inwardly from the edge ring and form a concentric ring. Lower main inner cables connect respective outer struts such that each of these cables intersects two other lower main inner cables at respective lower inner strut nodes. Each inner compression strut is supported at a respective lower inner strut node by two lower main inner cables and extends upwardly therefrom. The inner struts in plan view are spaced radially inwardly from the outer struts and form a concentric ring. A particular dome structure can utilize a multiplicity of inner strut systems located on a set of concentric rings. An upper structure is supported by the edge ring and by upper portions of the outer and inner struts, and a roof membrane covers at least a part of the system.

The upper structure comprises upper main outer and inner cables. The upper main outer cables connect respective edge ring nodes and each intersects two other upper main outer cables at two respective upper outer strut nodes, to which are secured upper portions of respective outer struts. The upper main inner cables connect upper portions of respective outer struts and each intersects two other upper main inner cables respective upper inner strut nodes, to which are secured upper portions of respective inner struts. The upper and lower outer strut nodes are secured to the edge ring nodes by respective upper and lower outer radial cables, and the upper and lower inner strut nodes are secured to the upper outer strut nodes by respective upper and lower inner radial cables.

In one variation the structure adds, on top, substantially rigid arches extending radially inwardly from the edge ring nodes. Each arch is supported at the edge ring and at upper portions of a respective outer strut and respective inner struts. Radial cables need not be used, but may be added if desired, particularly if they can be used to simplify the erection process.

This exemplary embodiment of the invention allows for particularly efficient erection. For example, in the case of the variation which does not use arches, after construction of the edge ring and any supports which raise it above grade, the lower main outer cables are hung from the edge ring nodes, one at a time. Then they are moved and connected to each other as needed. Next, the upper main outer cables are hung from the ring to a position inverted from their final position, i.e. to a position similar to that of the lower main outer cables. Then the outer struts are connected to hang from the inverted upper main outer cables. The outer periphery of the system is then completed by moving the outer struts upwardly and connecting them to the lower main outer cables. Then the first ring is completed by adding the upper and lower radial cables. The erection process for the inner ring of the structure is similar, except that the main inner cables are hung from the upper outer strut nodes. If a system has more than one inner ring, the process is repeated for the additional inner rings. The system is stressed by jacking the struts to move the respective upper and lower strut nodes apart. Roof fabric is then attached. The center of the structure can be formed by a central compression strut secured by lower and upper central radial cables connecting its lower and upper portions, respectively, to the upper inner strut nodes.

The variation which uses arches can be erected similarly. The edge ring and the lower and upper outer main cables are erected as in the previous variation. These cables are then moved and connected to each other as needed to define the lower outer strut nodes. The outer struts are then installed as in the previous variation. The radial outer segments of the arches can then be placed in their approximate final positions by attaching them to the edge ring and to the respective upper outer strut nodes. The inner main cables and inner struts can then be erected similarly, except that they are supported by the upper outer strut nodes rather than directly by the edge ring, and the next inner segments of the arches can be placed in their approximate final positions, resting on the respective outer upper nodes and inner upper strut nodes. If one or more further inner rings are to be constructed, the same procedure is followed. A central strut supported at its bottom end by radial cables secured to the upper nodes of the innermost struts, can be used as in the previous variation. The centermost segments of the arches can be supported by the upper portion of the central strut and the innermost upper strut nodes. Final prestressing can be done by expanding the struts, e.g. by providing telescoping struts, and then the structure can be covered with roof skin, such as fabric. One configuration of the fabric roof structure consistent and effective with this cable dome system has radial segments spanning between radially oriented valley cables each connecting the tops of related struts and the related edge ring node. In the center of each segment the fabric is supported by a ridge cable supported by flying struts suspended from the upper nodes of the cable dome system. In case of the arch reinforced variation the arches can, but need not, replace the valley cable.

BRIEF DESCRIPTION OF THE DRAWINGS

FIG. 1 is a perspective view of a portion of a structure embodying an example of the invention.

FIG. 2 is a elevational view of a lower main cable used in the structure of FIG. 1.

FIG. 3 is an elevational view of an upper main cable used in the structure of FIG. 1.

FIG. 4 is an elevational view of radial cable and struts used in the structure of FIG. 1.

FIG. 5*a* is an elevational view of two outer struts their radial cables, and of inner main cables and struts.

FIG. 9 illustrates "section A" of the structure of FIG. 8.

FIG. 10 illustrates "section B" of structure of FIG. 8.

FIG. 11 illustrates "section C" of the structure of FIG. 8.

FIG. 14*a* is a plan view of an edge ring node and FIG. 14*b* shows "section A" of FIG. 14*a*.

DETAILED DESCRIPTION

Figure 5:
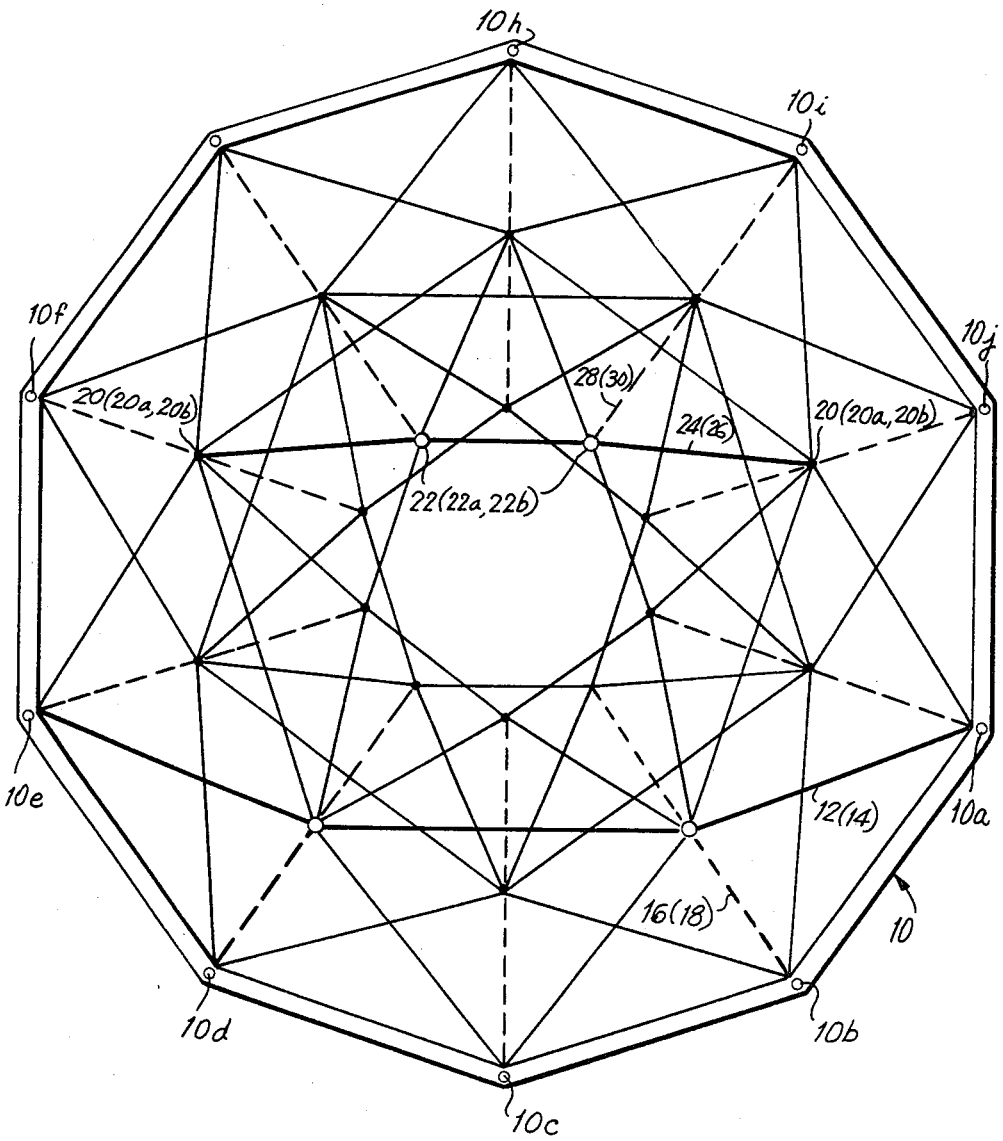
FIG. 5 is a plan view of a nearly completed structure.

Referring to FIGS. 1–4, a structure embodying an example of the invention comprises an edge ring 10 which is in the form of a 10-sided polygon and is raised above grade on columns 11. Ring 10 is substantially rigid, for example made of reinforced concrete, and extends generally laterally. At its apices it has cable attachment nodes 10*a* through 10*d*. A respective lower main outer cable 12 connects each edge ring node with the edge ring node spaced from it by (in this example) three other edge ring nodes. For example, a lower main outer cable 12 connects edge ring node 10*a* to edge ring node 10*e*. Outer compression struts 20 are spaced in plan view radially inwardly from edge ring 10 and form a circle concentric with edge ring 10. Each outer strut 20 is supported at its lower portion at a lower outer strut node 20*a* at the intersection of two lower main outer cables 12. For example, a node 20*a* is at the intersection of the cable 12 which connects edge ring nodes 10*a* and 10*e* and the cable 12 which connects edge ring nodes 10*c* and 10*g*. As seen in FIG. 2, each lower main outer cable 12 intersects two lower outer strut nodes 20*a*. An upper structure includes upper main outer cables 14 each of which can (but need not) be aligned in plan view, and is spaced upwardly in elevational view, from a respective lower main outer cable 12, and can (but need not) connect the same edge ring nodes as its corresponding cable 12. Note that in the illustrated embodiment each upper main cable is aligned in plan view with a corresponding lower main cable; however, this need not be the case. For example, one main lower (or upper) cable can extend from one edge ring node to another which is spaced by four other edge nodes, and the corresponding upper (lower) cable can extend between two edge ring nodes which are spaced from each other by only two other edge nodes. In general, any number of nodes more than one per main cable can generate main cable connections. Upper main cables and lower main cables need not be identical in plan configuration. Two upper main inner cables 14 intersect each other at each upper outer strut node 20*b*, to which the upper portion of a respective outer strut 20 is connected. For example, the upper main outer cables 14 which connect edge ring nodes 10*a* and 10*e* to each other and 10*c* and 10*g* to each other, intersect at an upper outer strut node 20*b*. As seen in FIG. 3, each upper main outer cable intersects two upper outer strut nodes 20*b*. In addition, the outer ring of the structure may, but need not, include lower outer radial cables 16 and upper outer radial cables 18. Each cable 16 connects a respective edge ring node with a respective lower outer strut node, and each cable 18 connects a respective edge ring node to a respective upper outer strut node 20*b*, as illustrated in FIGS. 1 and 4.

Referring to the non-limiting example shown in the plan view of FIG. 5, each lower outer main cable 12 is aligned with its corresponding upper main outer cable 14, and the pair of matching outer main cables is therefore seen as a single line. Similarly, in the plan view of FIG. 5 each outer strut 20 appears as a point coinciding with its lower and upper outer strut nodes 20*a* and 20*b*. Also seen in FIG. 5 are the cables and struts forming an inner ring, spaced radially inwardly from the outer ring formed by cables 12 and 14, struts 20 and cables 16 and 18. The inner ring corresponds in structure to the outer ring, except that its cables attach to upper outer strut nodes 20*b* rather than to edge ring nodes. For example, as seen in FIGS. 5 and 5*a*, two outer struts 20 are connected to edge ring nodes 10*f* and 10*j* by respective radial cables 16 and 18 and, extending between their upper nodes 20*b* are inner lower main cable 24 and upper inner main cable 26, which support inner struts 22 at respective lower inner strut nodes 22*a* and upper inner strut nodes 22*b*. As with the outer main cables, each lower inner main cable supports two inner struts 22, and each inner strut 22 is supported at the intersection of two lower inner main cables 24. Similarly, each upper inner main cable 26 is secured to two inner struts 22 at respective upper inner strut nodes 22*b*, which are at the upper portions of the inner struts 22, and each upper inner strut node 22*b* is at the intersection of two upper inner main cables 26. Referring to FIGS. 4 and 5, each inner strut 22 can (but need not) be secured to the nearest upper outer strut node 20*b* by a lower inner radial cable 28 and an upper inner radial cable 30. Each cable 28 connects a node 22*a* to a node 20*b*, and each cable 30 connects a node 22*b* to a node 20*b*.

Each cable can comprise two or more separate subcables, which can make cable transportation and erection easier, particularly when large spans necessitate long cables. Using subcables can also simplify the strut node connections.

The system affords unprecedented flexibility by allowing design freedom in choosing the radial distance from the edge ring to the ring of outer struts and the one or more rings of inner struts, and in choosing the slopes of the radial cables.

Figure 6:
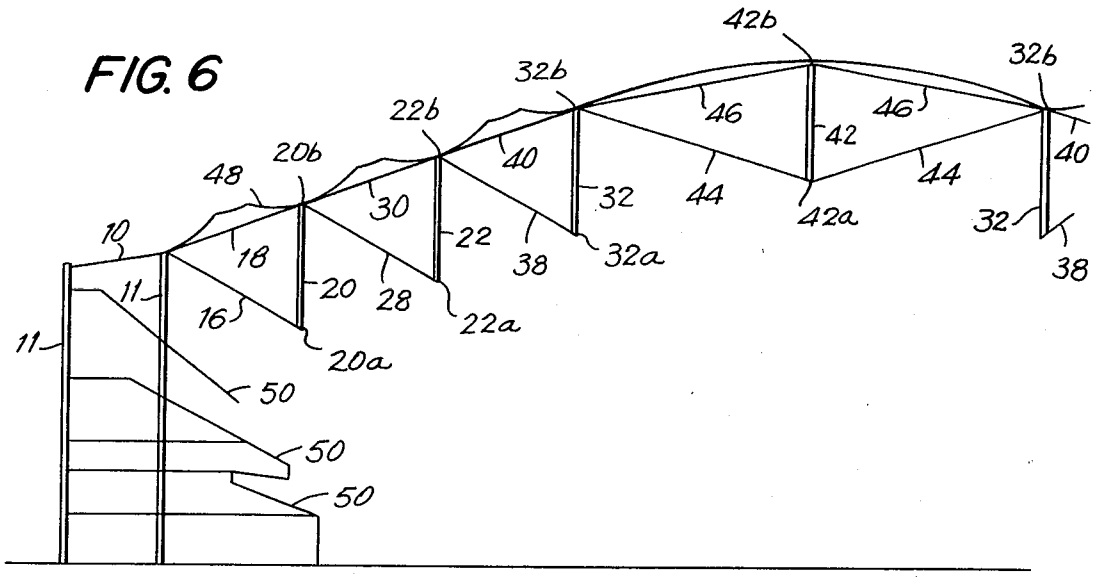
FIG. 6 is a partial sectional view of a structures as in FIG. 1, as applied to a full-size stadium.
Figure 6A:
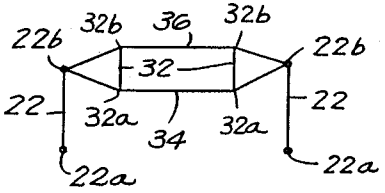
FIG. 6*a* is an elevational view of two inner struts supporting second inner lower and upper main cables and second inner struts.

If desired, there can be one or more additional inner rings each of which is similar to that formed by inner struts 22 and inner cables 24, 26, 28 and 30. Each additional inner ring is supported by the upper strut nodes of the preceding ring in the same manner as the first inner ring is supported by upper nodes 20*b*, and each is spaced radially inwardly from the preceding inner ring. For example, as seen in FIGS. 6 and 6*a* there can be a second inner ring formed of second inner ring struts 32, second lower inner main cables 34, second upper inner main cables 36, second lower radial cables 38 and second upper radial cables 40.

As the system acts as a cantilever from the edge ring inward, the center can be left open, or can be closed by any structural subsystem compatible with the structure. For example, the center of the structure can be formed as illustrated in FIG. 6 by a central strut 42, lower central radial cables 44 which connect the node 42*a* (at the bottom of central strut 42) to the upper nodes of the nearest inner struts, in this case the upper nodes 32*b* of innermost struts 32, and upper central radial cables 46 which connect the node 42*b* (at the upper portion of central strut 42) to the same innermost upper strut nodes, in this case nodes 32*b*. Roof skin 48 can be secured as described in greater detail below to cover the structure. As seen in FIG. 6, the structure can include radially spaced columns 11 to support edge ring 10, and stadium seats 50.

Figure 7:
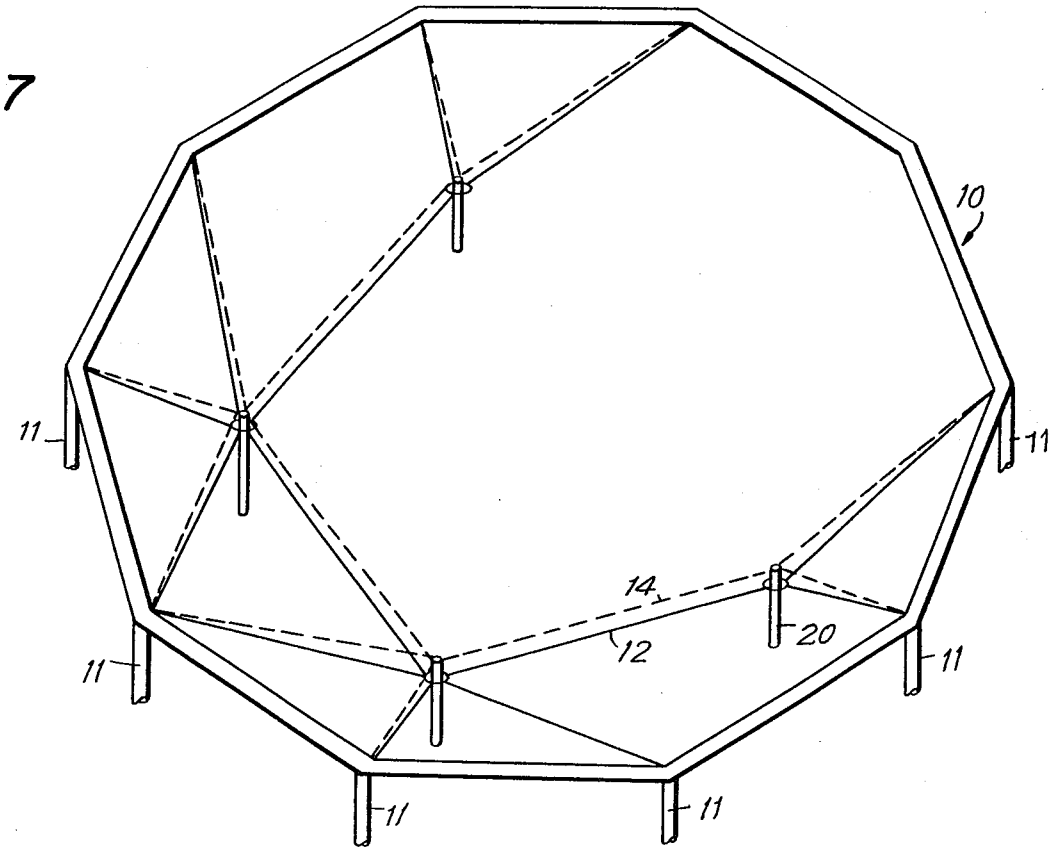
FIG. 7 is a view similar to FIG. 1 but showing a step in erecting the structure.

Referring to FIG. 7, the invented structure can be erected by first constructing the support columns 11, using conventional techniques for forming reinforced concrete support columns, and then edge ring 10. If the size of the structure allows it, the segments of edge ring 10 which form the sides of the illustrated polygon can be prefabricated and lifted in place on top of columns 11; if not, each side of the polygon forming edge ring 10 can be cast in situ, for example one side at a time, with appropriate provisions for edge ring nodes 10*a*–10*j*. The lower main outer cables 12 are then hung from the appropriate edge ring node 10*a*–10*j*, for example, one at a time. They are then moved as needed to define the lower outer struts nodes 20*a*, and are secured to each other at nodes 20*a*. At this stage, each lower main cable 12 is in a position such as illustrated for the three cables 12 shown in FIG. 7. Next, the upper main outer cables 14 are hung from the respective edge ring nodes 10*a*–10*j*, to positions inverted from their final positions, i.e. to positions similar to those of the lower main outer cables 12. Then cables 14 are moved as needed to define upper outer strut nodes 20*b*, and outer struts 20 are hung from those nodes 20*b*, to positions approximating those illustrated in FIG. 7 for three cables 14 and four struts 20. The outer ring of the system is then completed by moving outer struts 20 upwardly, relative to lower outer cables 12 and nodes 20*a*, connecting struts 20 to nodes 20*a*, and connecting lower and upper outer radial cables 16 and 18. The next inner ring is erected similarly, except that outer strut nodes 20*b* are used in place of the edge ring nodes 10*a*–10*j*. Any subsequent inner rings which may be used are erected in the same manner, each using for support the upper strut nodes of the preceding ring. The system can be stressed as needed by using telescoping outer and inner struts and jacking them to move the respective upper and lower strut nodes apart. The center of the structure can be left open, or a center can be erected by hanging central lower central radial cables 44 between the lower central node 42*a* and the upper nodes of the innermost struts, then hanging upper central radial cables 46 between upper central node 42*b* and the respective upper nodes of the innermost ring of struts, and hanging central strut 42 from node 42*b* and jacking it up and securing its lower edge to lower central node 42*a*. Roof skin 48, such as roof fabric, can be attached to the structure.

Figure 8:
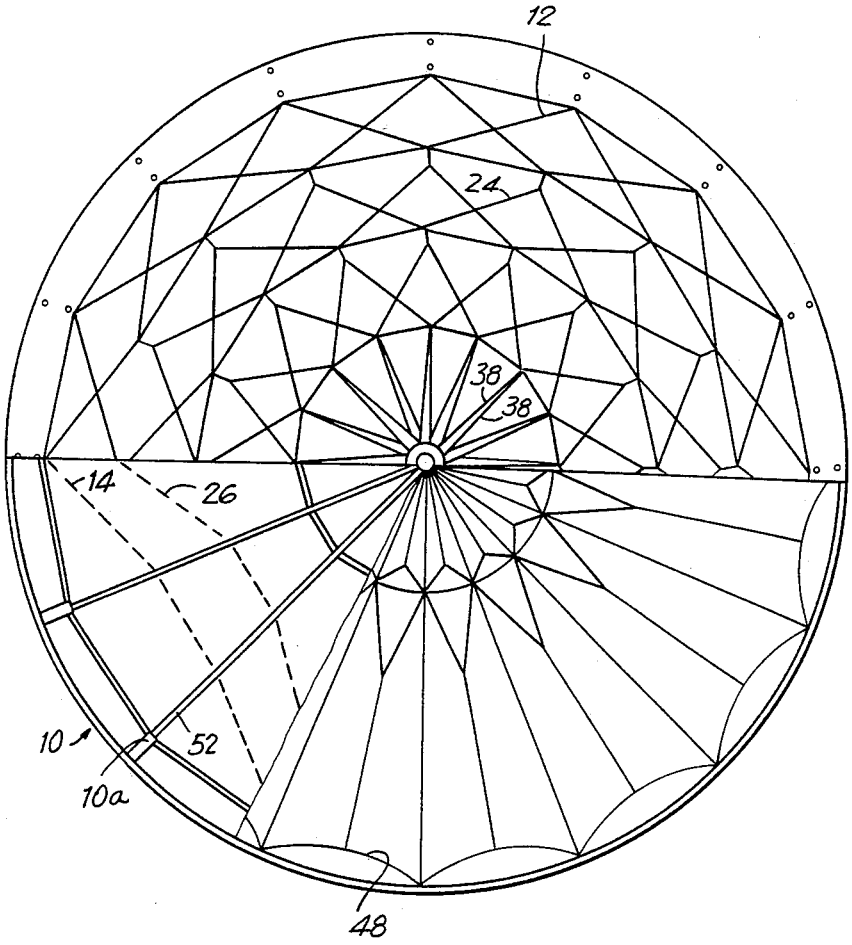
FIG. 8 is a plan view, partly cut away, of a structure embodying another example of the invention, using top arch reinforcement.

Another variation of the invention is illustrated in FIGS. 8–11. It differs from the previously described variation in that its upper structure is reinforced by arches 52. Referring to FIGS. 8 and 9, each arch 52 extends radially between a respective edge ring node and the center of the structure and can be made up of several segments. For example, the radially outermost segments can extend from edge ring 10 to the respective outer upper strut nodes 20*b*, the next radially inwardly segments can extend from the respective nodes 20*b* to the next radially inward nodes 22*b*, etc., and the radially innermost segments can extend from the respective struts of the innermost ring of struts to the center of the structure. For the center of the structure, a central strut and a system of central radial cables can be used, as in the previous variation, or the central strut can be replaced by a center tube 62 serving a similar function. The struts in the rings of the variation illustrated in FIGS. 8 and 9 are inclined with respect to the vertical while those in the previous variation are shown as substantially vertical. However, this is not a limitation on the invention; this angle is a design choice and can be changed as desired or needed. FIG. 10 illustrates a section showing edge ring 10, one outer lower main cable 12, two struts 22 and two upper main cables 14, and FIG. 11 illustrates a section of an arch, showing that it can be constructed as a truss of steel or similar materials.

If additional stiffening is desired, the variation of FIGS. 8–11 can use bracing cables, such as 54, each connecting a respective upper strut node of an outer strut to the two nearest edge ring nodes, and in the case of an inner strut, its upper node to the two nearest lower strut nodes of the preceding ring of struts.

The erection of the variation illustrated in FIGS. 8–11 is similar to that discussed in connection with FIGS. 1–7, except for the fact that arch segments are added and the radial cables can be omitted. In particular, for the variation of FIGS. 8–11, columns 11 and edge ring 10 are erected as in the previous variation, and the lower outer main cables 12 are hung and moved and connected as needed to define lower outer strut nodes 20*a* in the same manner. The outer upper main cables 16 are then hung from the respective edge ring nodes and the upper portions of outer struts 20 and are moved and connected as needed to define outer upper strut nodes 20*b*. Struts 20 are then jacked up to move them up relative to the respective lower outer cables 14, and the bottom portions of struts 20 are secured to the respective lower outer strut nodes 20*a*. The outermost segments of arches 52 are positioned by connecting their radially outward ends to edge ring 10 and their radially inward ends to outer strut nodes 20*b*. Each successive inner rings is then constructed similarly.

Figure 12:
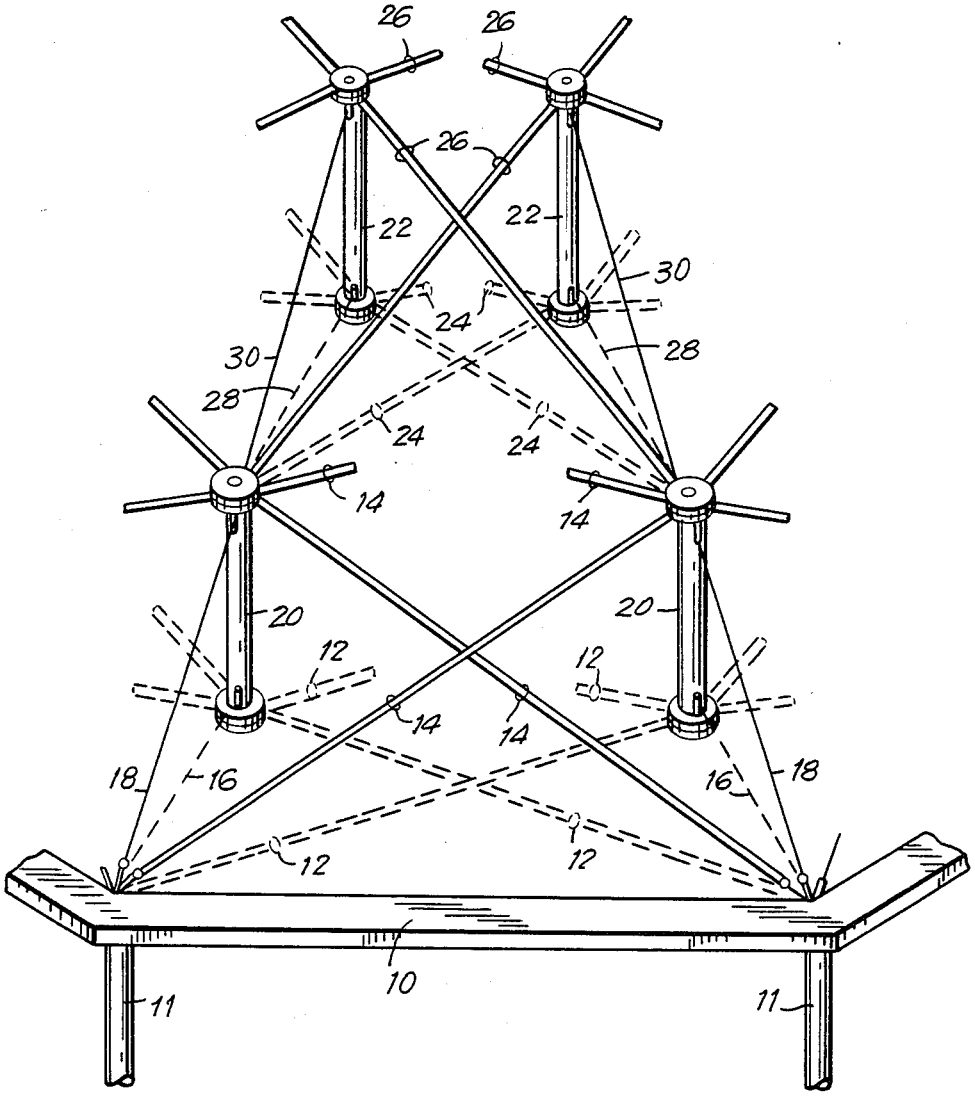
FIG. 12 is a partial perspective view illustrating an first exemplary embodiment of the invention.

FIG. 12 illustrates, in a perspective view, the relative positions of edge ring 10 and its supporting columns 11, compression struts 20 and 22, outer lower main cables 12 which in plan view run along chords of the edge ring 10 and, in this case, comprise two parallel subcables, upper outer main cables 14 which in plan view are aligned with their corresponding cables 12 (in this example) and also comprise two parallel subcables each, lower and upper outer radial cables 16 and 18 respectively, and corresponding cables of the inner ring.

Figure 13:
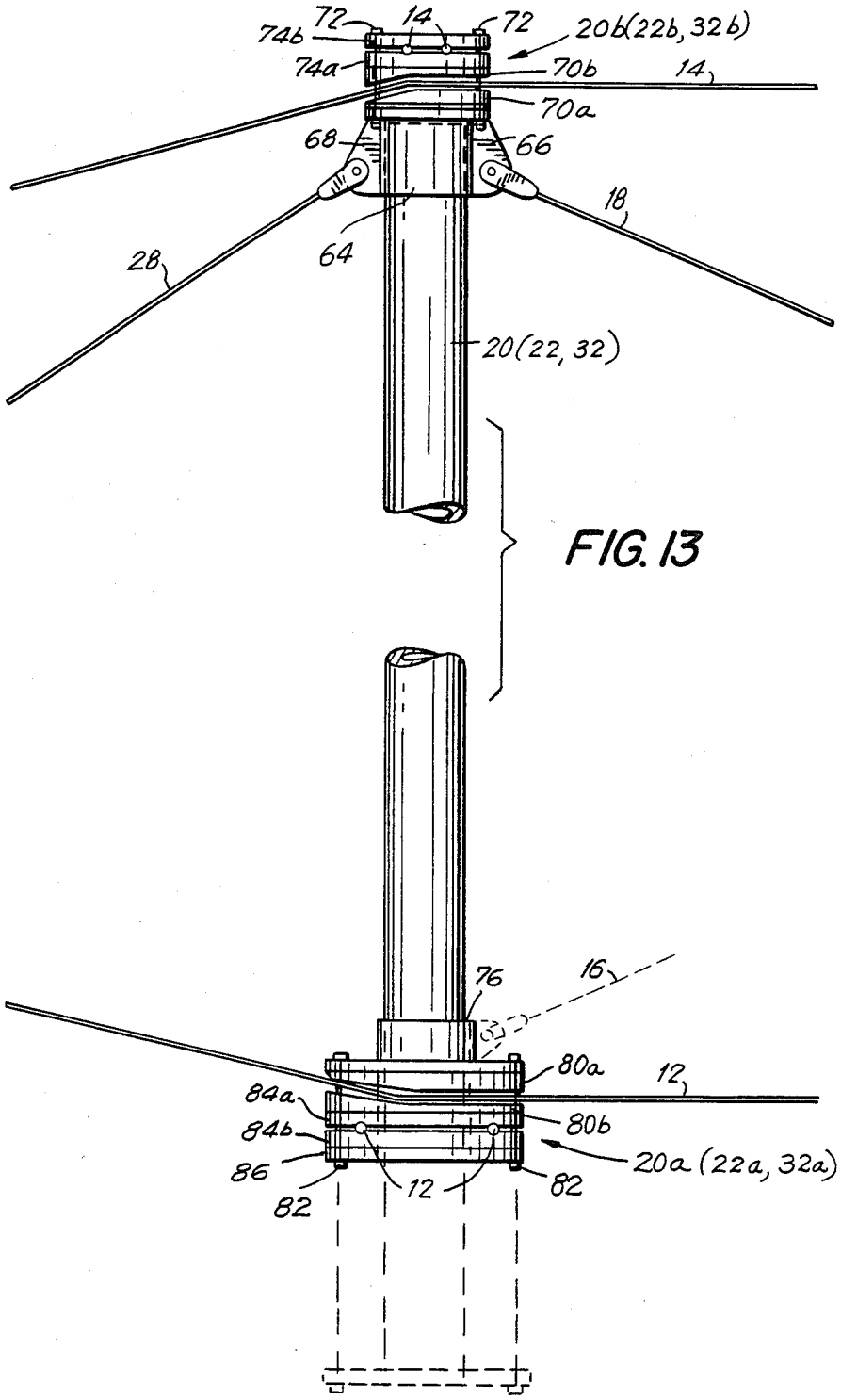
FIG. 13 is a partial elevation view illustrating a compression strut.

FIG. 13 illustrates an exemplary compression strut, such as 20 or 22 or 32. The upper edge node (20*b* or 22*b* or 32*b*) comprises a sleeve 64 which has two flanges 66 and 68. If the compression strut is an outer strut 20, then flange 66 is secured to an upper radial cable 18 which goes to an edge ring node, and flange 68 is secured to a lower radial cable 28 which goes to a lower node 22*a* of a compression strut of the first inner ring. A raceway for a cable 14 is formed between a grooved bottom clamping plate 70*a* (affixed to sleeve 64 and to the top of strut 20) and a grooved top clamping plate 70*b* (secured to bottom plate 70*a* and thus to strut 20 by bolts 72, two of which are schematically illustrated). A similar connection is provided for the other cable 14 which intersects the same upper node 20*b*, by means of a raceway formed between clamping plates 74*a* and 74*b*. A flange and a connection for an upper radial cable 30 can be provided in the same manner as discussed above for lower radial cable 28. A similar structure is used for a lower node, such as 20*a*, as illustrated in FIG. 13. If the strut illustrated in FIG. 13 is an outer strut 20, then a sleeve 76 has a flange 78 to which is secured an outer lower radial cable 16. Sleeve 76 is affixed to strut 20, and also affixed to strut 20 is a clamping plate 80*a* which, together with clamping 80*b* which is secured thereto with bolts such as 82, similarly forms a raceway for cable 12. Another pair of clamping plates 84*a*, 84*b* is also secured by means of the same bolts 82, to form a raceway for an intersecting pair of subcables forming a cable 12. In erecting the structure, an upper node such as 20*b* can be formed by securing the appropriate intersecting cables 14 in their respective raceways formed by plates 74*a*, 74*b* and 70*a*, 70*b*, and then, if radial cables are used, securing the appropriate radial cable of radial cables to the same node. A lower node such as 20*a* can be formed in a similar manner but this time using lower main cables and radial cable. The appropriate strut, such as 20, is then threaded upwardly through sleeve 76 and through sleeve 64 until it bears against the lower clamping plate (in this case, plate 70*a*, which is affixed to sleeve 64). Strut 20 is then jacked up to separate sleeves 64 and 76 by the required distance, and clamping plate 84*b* (and, if desired, a clamping plate 86) is secured to sleeve 76 by means of bolts such as 82.

A detail of an edge ring node such as 10*a*, is illustrated in FIGS. 14*a* and 14*b* and comprises a unitary metal structure, such as made of welded structural steel, which is affixed in a known manner to edge ring 10 and comprises support plates such as 88, 90, 92, 94 and 96. One such plate, 88, is shown in an elevation in FIG. 14*b* (section A of FIG. 14*a*) and as illustrated supports a lower cable 12 and an upper cable 14. In fact, as each cable 12 and each cable 14 is made up of two subcables, the view of FIG. 14*b* shows plate 88 as supporting one subcable 12 and one subcable 14.

Figure 15:
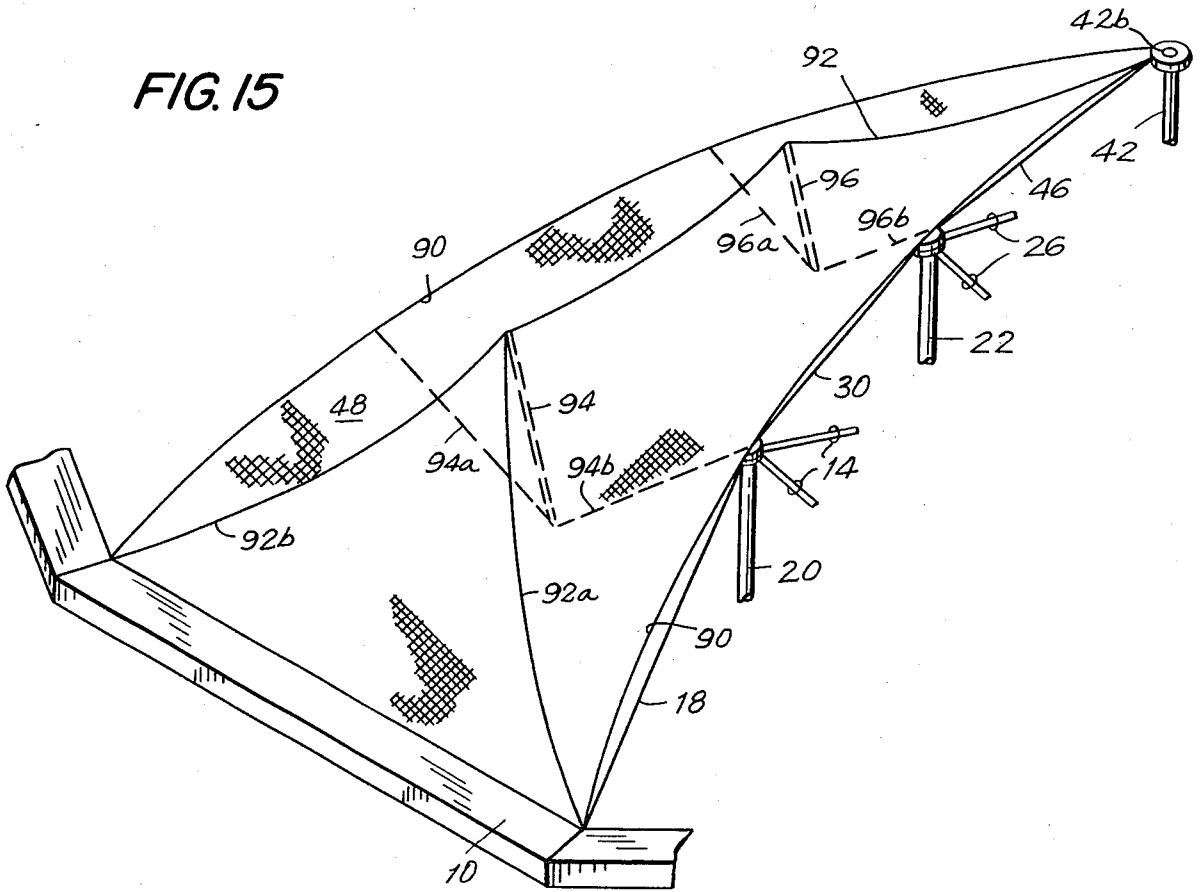
FIG. 15 is a partial perspective view illustrating the roof cover of the first exemplary embodiment of the invention.

FIG. 15 illustrates a roof cover for the first variation of the invention. A radial segment of roof skin 48, such as roof fabric, is held down at the sides by two valley cables 90, which are over skin 48 and are secured by suitable waterproof connectors to the edge ring nodes and upper strut nodes over which they pass. A ridge cable 92 is under roof skin 48 and is supported by the upper portions of flying struts 94 and 96, which in turn are supported by respective chord cables 94*a*, 94*b* and 96*a*, 96*b*. At its radially outer portion ridge cable 92 splits in portions 92*a* and 92*b*, which connect to respective nodes of edge ring 10. The radially outward end of each segment of roof skin 48 can be clamped or otherwise secured to edge ring 10 in a waterproof connection. The system can be erected by installing cables 94*a*, 94*b* and 96*a*, 96*b*, laying on the segment of roof skin 48 and connecting valley cables 90 and ridge cable 92 and its ends 92*a*, 92*b*, hanging flying struts 94 and 96 from the ridge cable and tightening the roof by jacking up the flying struts relative to their support cables, using node connections and telescoping techniques similar to those discussed in connection with FIGS. 13–14*b* above.

Figure 16:
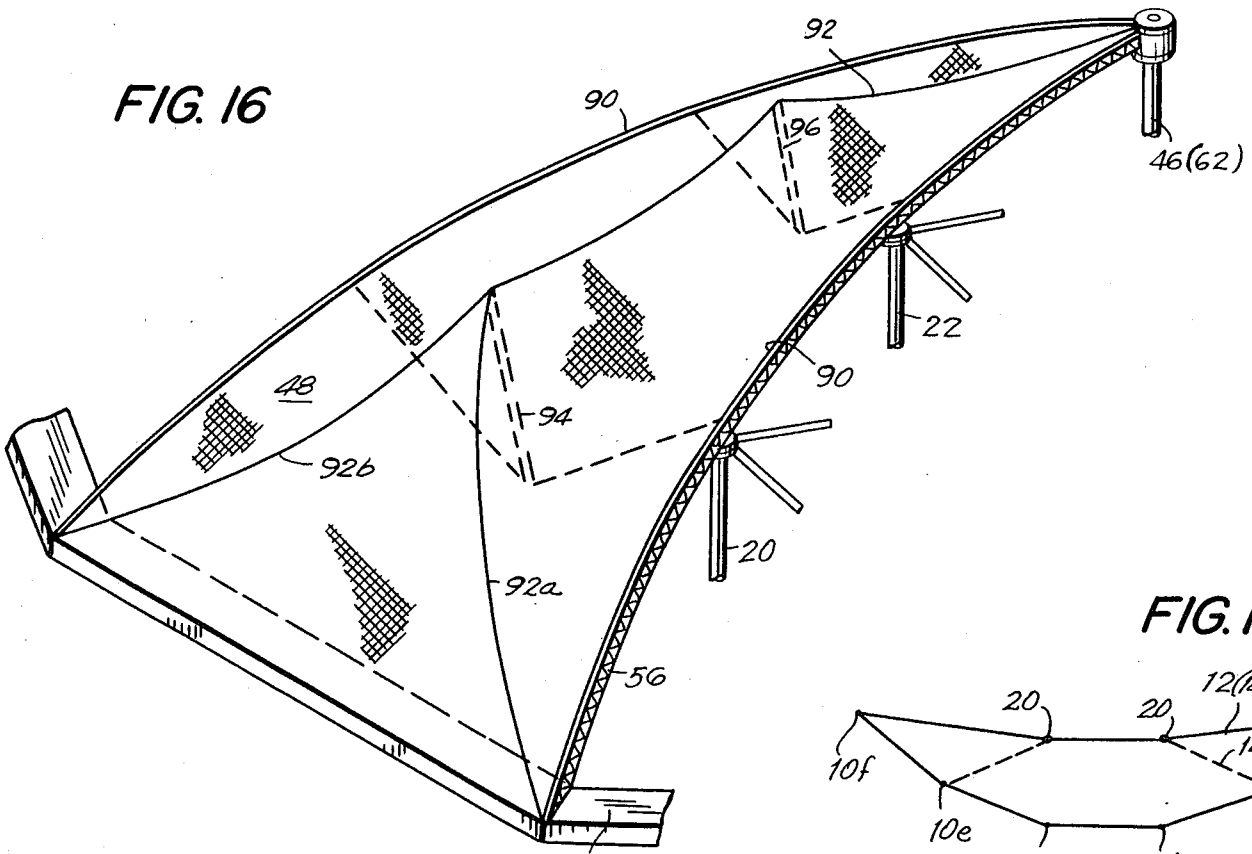
FIG. 16 is a partial perspective view illustrating the roof cover of the second exemplary embodiment of the invention.

FIG. 16 illustrates a roof skin segment for the second variation of an embodiment of the invention, which uses reinforcing arches 56. As shown, the roof skin segment is connected in the same manner, except that valley cables 90 are connected to the respective arches 56 rather than to upper strut nodes, and the radially outer edge of the roof skin segment is shown as connected to the outer perimeter of edge ring 10. Note that while valley cables 90 can be used, as shown, they can be omitted if the roof skin segment is secured directly to the respective arches 56. For example, if the arches curve continuously, it may be preferable to omit the valley cables; if the arches are formed of segments which extend along straight lines between radially spaced strut nodes it may be more desirable to use valley cables.

Figure 17:
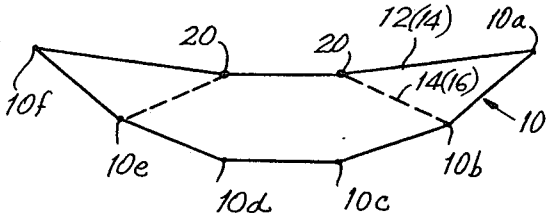
FIG. 17 is a partial plan view of main cables and the edge ring.

FIG. 17 illustrates the use of upper and lower main cables which are not aligned in plan view. In the illustrated example a lower (or upper) outer main cable 12 (or 14) connects edge ring nodes 10*a* and 10*f*, but its corresponding upper (or lower) outer main cable 14 (or 12) connects edge ring nodes 10*b* and 10*e*. The same pattern can be repeated for inner rings.

The upper and lower strut nodes can define upper and lower surfaces which have different slopes. For example, the roof can be flatter than the surface defined by the lower strut nodes. If desired, a night curtain can be used below the roof skin.

I claim:

1. A cable dome system comprising:

a substantially rigid, generally laterally extending edge ring which has cable attachment nodes;

outer compression struts which in plan view are spaced radially inwardly from the edge ring;

lower outer main cables which connect respective edge ring cable attachment nodes and each of which intersects two other lower outer main cables at two respective lower outer strut nodes, wherein each outer strut is supported at a respective lower outer strut node by two lower outer main cables and extends upwardly therefrom;

inner compression struts which in plan view are spaced radially inwardly from the outer struts;

lower inner main cables which connect upper portions of respective outer struts and each of which intersects two other lower inner main cables at respective lower inner strut nodes, wherein each inner strut is supported at a respective lower inner strut node by two lower inner main cables and extends upwardly therefrom;

an upper structure supported by the edge ring and by upper portions of the outer and inner struts; and a roof membrane covering at least a part of the system.

2. A cable dome system as in claim 1 in which the upper structure comprises:

upper outer main cables which connect respective edge ring cable attachment nodes and each of which intersects two other upper outer main cables at two respective upper outer strut nodes, wherein each outer strut is secured at an upper portion thereof to two upper outer main cables at a respective upper outer strut node; and upper inner main cables which connect upper portions of respective outer struts and each of which intersects two other upper inner main cables at respective upper inner strut nodes, wherein each inner strut is secured at an upper portion thereof to two upper inner main cables at a respective upper inner strut node.

3. A cable dome system as in claim 2 including:

lower outer radial cables each of which connects a respective edge ring cable attachment node and a respective lower outer strut node;

upper outer radial cables each of which connects a respective edge ring cable attachment node and a respective upper outer strut node;

lower inner radial cables each of which connects a respective upper outer strut node and a respective lower strut node; and upper inner radial cables each of which connects a respective upper outer strut node and a respective upper inner strut node.

4. A cable dome system as in claim 3 in which in elevational view the lower main cables are generally arched downwardly and the upper main cables are generally arched upwardly.

5. A cable dome system as in claim 4 in which in plan view each main cable is offset from a straight line joining the edge ring nodes which the cable connects.

6. A cable dome system as in claim 5 in which in elevational view the upper outer strut nodes are closer to the ring than the lower outer strut nodes.

7. A cable dome system as in claim 6 including a central strut having an upper portion which is higher than the upper portions of the outer and inner struts and a structure for supporting the central strut substantially at the plan view center of the edge ring.

8. A cable dome system as in claim 7 in which the edge ring is a polygon having at least eight sides.

9. A cable dome system as in claim 2 in which the upper and lower main cables are not aligned in plan view.

10. A cable dome system as in claim 2 in which the upper structure includes substantially rigid reinforcing arches extending radially inward from the edge ring cable attachment nodes, wherein each arch is supported at the edge ring and at upper portions of a respective outer strut and one or more respective inner struts.

11. A cable dome system as in claim 1 in which the upper structure includes substantially rigid reinforcing arches extending radially inward from the edge ring cable attachment nodes, wherein each arch is supported at the edge ring and at upper portions of a respective outer strut and one or more respective inner struts.

12. A cable dome system comprising:

a substantially rigid, generally laterally extending edge ring which has cable attachment nodes;

outer compression struts which in plan view are spaced radially inwardly from the edge ring;

upper and lower outer main cables, wherein (i) each cable is supported at its ends at respective cable attachment nodes spaced from each other along the edge ring by at least two other cable attachment nodes, (ii) each lower outer main cable intersects at least two other lower outer main cables at respective lower outer strut support nodes and each upper outer main cable intersects at least two other upper outer main cables at respective upper outer strut support nodes, (iii) the lower cables are spaced from the upper cables in elevational view, and (iv) the upper main cables are generally arched downwardly in elevational view while the lower are generally arched downwardly in elevational view;

inner compression struts which in plan view are spaced radially inwardly from the outer struts;

upper and lower inner main cables, wherein (i) each main inner cable is supported at its ends at respective upper outer strut support nodes, (ii) each lower inner main cable intersects at least two other lower inner main cables at respective lower inner strut support nodes and each upper inner main cable intersects at least two other upper inner main cables at respective upper inner strut support nodes, (iii) the lower inner cables are spaced from the upper inner cables in elevational view, and (iv) the upper inner main cables are generally arched downwardly in elevational view while the lower are generally arched upwardly in elevational view; and a roof membrane covering at least a part of the system.

13. A cable dome system as in claim 12 including an edge ring support structure which maintains at least a portion of the edge ring above ground level.

14. A cable dome system as in claim 12 including outer radial cables each having ends supported at a respective cable attachment node at the edge ring and at an outer strut support node, and inner radial cables each having ends supported at a respective upper outer strut support node and at an inner strut support node.

* * * * *